United States Patent [19]

Tjumanok et al.

[11] Patent Number: 4,659,025

[45] Date of Patent: Apr. 21, 1987

[54] DISINTEGRATOR

[76] Inventors: Alexei N. Tjumanok, ulitsa Vase, 3, kv. 18; Yaan V. Tamm, bulvar Sypruse, 11, kv. 3, both of Tallin, U.S.S.R.

[21] Appl. No.: 769,985

[22] PCT Filed: Nov. 6, 1984

[86] PCT No.: PCT/SU84/00066

§ 371 Date: Jul. 11, 1985

§ 102(e) Date: Jul. 11, 1985

[87] PCT Pub. No.: WO85/02558

PCT Pub. Date: Jun. 20, 1985

[30] Foreign Application Priority Data

Dec. 5, 1983 [SU] U.S.S.R. ..... 3692048

[51] Int. Cl.[4] ..... B02C 13/20

[52] U.S. Cl. ..... 241/187; 241/188 R

[58] Field of Search ..... 241/55, 188 R, 188 A, 241/187, 300

[56] References Cited

U.S. PATENT DOCUMENTS 3,028,105 4/1962 Perrine ..... 241/188 R
3,894,695 7/1975 Benedikter .

FOREIGN PATENT DOCUMENTS 202610 11/1967 U.S.S.R. .
541497 3/1977 U.S.S.R. .
884720 11/1981 U.S.S.R. .
908383 3/1982 U.S.S.R. .
1071309 3/1984 U.S.S.R. .

*Primary Examiner*—Mark Rosenbaum
*Attorney, Agent, or Firm*—Burgess, Ryan & Wayne

[57] ABSTRACT

A disintegrator according to the invention comprises a milling chamber (1) accommodating rotors rotating in opposite directions relative to each other. The rotors comprise carrier discs (4, 11) and disintegrating wheels (6, 13) concentrically mounted thereon. Each disintegrating wheels (6 or 13) comprises a cylindrical shell (17) having openings (18) and milling bodies (19) provided behind the openings on one side thereof. In addition, the wheel is also provided with a pair of guard members (20, 21) installed in mutually perpendicular planes which are designed to prevent a material (15) being disintegrated from getting into spaces between the carrier discs (4, 11) and disintegrating wheels (6, 13). One guard member (20) comprises a ring mounted on the periphery of the shell (17) on the inner side thereof to extend around the group of the milling bodies (19). The other guard member (21) comprises a cylindrical ring secured to the inner side of the respective carrier disc (4, or 11) opposite to the first guard member (20), the outside diameter thereof being substantially equal to the inside diameter if the shell (17) and the height being substantially equal to the amount of space between the carrier disc (4 or 11) and the end face of the shell (17).

1 Claim, 3 Drawing Figures

DISINTEGRATOR

FIELD OF THE ART

The invention relates to the comminution of materials, and more particularly, to a disintegrator.

STATE OF THE ART

Known in the art is a grinding apparatus (cf. USSR Inventor's Certificate No. 202610), comprising a rotor in the form of a disc provided with milling bodies in the form of pins.

A substantial part of air and fines in the milling apparatus of this type flows around the end face portion of pins so that efficiency of comminution is low.

In addition, if large-size foreign bodies get into the milling apparatus by accident, jamming of the pins occurs to result in damage to the drive shafts and deformation of the rotor disc.

Known in the art is a disintegrator (cf. U.S. Pat. No. 3,894,695), comprising rotors in the form of discs having working wheels secured thereto. Each wheel consists of a pair of rings between which there are provided milling bodies in the form of plates.

In operation, the material is treated by the milling bodies through collisions. Air flow moves together with the material. The air rotates together with the working wheel while at the same time moving radially outwards. A boundary air layer moves on either side of the rings under the action of centrifugal forces together with particles of material causing wear of the plates. As a result, the radial plates wear more rapidly than the milling bodies thus increasing the probability of failure.

Known in the art is a disintegrator (cf. USSR Inventor's Certificate No. 541497), comprising a milling chamber accommodating drive shafts and two rotors mounted thereon which rotate in opposite directions relative to each other. The first rotor comprises a carrier disc mounted on the drive shaft supporting concentrically disposed wheels for disintegrating the material. The second rotor comprises a transfer disc mounted on the drive shaft in parallel with the carrier disc of the first rotor. A distribution wheel is provided on the periphery of the transfer disc, and a carrier disc is mounted on the distribution wheel in parallel with the carrier disc of the first rotor. Wheels for disintegrating the material are concentrically mounted on the carrier disc, each wheel being disposed between two adjacent disintegrating wheels of the first rotor. Each disintegrating wheel of both rotors comprises a cylindrical wheel with openings, a milling body being provided behind each opening on one side thereof. The milling body comprises a circularly bent plate having its concave surface facing toward the opening and opposite to the direction of rotation of a respective carrier disc.

The disintegrator has pipes for charging a material to be treated and for discharging the comminuted material.

The material being treated is fed through the charging pipe and passes through the rotors where it collides with the milling bodies. Air flow moves together with the material. The air flow is split by the milling bodies and a part of the air moves together with the material laterally over the outer edge of the cylindrical shell. This part of the material causes undesired wear of the opposite carrier disc while the material is comminuted less efficiently on the next disintegrating wheel. If large-size foreign bodies get into the apparatus by accident, the speed of the disintegrating wheels and rotors materially decreases thus causing deformation of the carrier discs and drive shafts.

SUMMARY OF THE INVENTION

The invention is based on the problem of providing a disintegrator which has rotors so constructed as to improve efficiency of grinding of a material and also to avoid the possibility of damage to the drive and carrier discs by accident.

This problem is solved by that in a disintegrator comprising pipes for charging a material to be disintegrated and discharging the comminuted material, a milling chamber accommodating a pair of rotors mounted on drive shafts for rotation in opposite directions relative to each other, the first rotor comprising a carrier disc mounted on the drive shaft and disintegrating wheels concentrically mounted thereon and the second rotor comprising a transfer disc mounted on the drive shaft in parallel with the carrier disc of the first rotor, a distribution wheel mounted on the periphery of the transfer disc, a carrier disc secured to the distribution wheel coaxially with the carrier disc of the first rotor, and disintegrating wheels concentrically mounted on the carrier disc, each disintegrating wheel being disposed between two adjacent disintegrating wheels mounted on the carrier disc of the first rotor, each of all said disintegrating wheels comprising a cylindrical shell having openings and a milling body provided behind each opening on one side thereof, the milling body comprising a circularly bent plate having its concave side facing toward the opening and opposite to the direction of rotation of a respective carrier disc, according to the invention, each of the disintegrating wheels mounted on the carrier discs of both rotors is provided with guard members extending in mutually perpendicular planes and designed to prevent the material being disintegrated from getting into spaces between the disintegrating wheels and carrier discs, one guard member, which comprises a ring, being installed on the periphery of the cylindrical shell on the inner side side thereof to extend around the group of milling bodies provided on this cylindrical shell, the other guard member, which comprises a cylindrical ring, being secured to the inner surface of a respective carrier disc opposite to the guard member provided on the cylindrical shell, the outside diameter of the guard member secured to the carrier disc being substantially equal to the inside diameter of the cylindrical shell and the height thereof being substantially equal to the amount of space between the respective carrier disc and end face of the cylindrical shell.

The invention makes it possible to direct air flow and the material being disintegrated exclusively to the working zone of the disintegrating wheel thereby improving efficiency of comminution and, in case of foreign bodies getting by accident into the apparatus, to avoid damage of drive and carrier discs.

BRIEF DESCRIPTION OF THE DRAWINGS

The invention will now be described with reference to a specific embodiment thereof illustrated in the accompanying drawings, in which.

PREFERRED EMBODIMENT OF THE INVENTION

Figure 1:
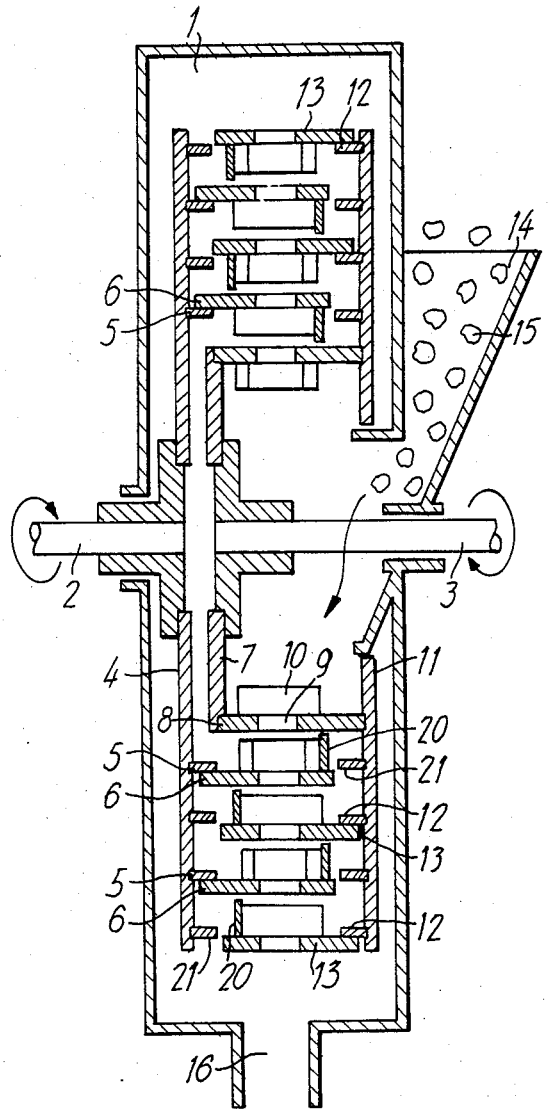
FIG. 1 is a general view, in cross-section of a disintegrator according to the invention.

A disintegrator comprises a milling chamber 1 (FIG. 1) accommodating drive shafts 2 and 3 having rotors installed there on. Directions of rotation of the rotors are indicated by arrows. A rotor installed on the shaft 2 comprises a carrier disc 4 to which by means of support rings 5 are concentrically secured disintegrating wheels 6. A rotor installed on the shaft 3 comprises a transfer disc 7 mounted on the shaft 3 in parallel with the carrier disc 4. A distribution wheel 8 is mounted on the periphery of the transfer disc 7 and comprises a cylindrical shell having openings 9 and milling bodies 10 provided behind each opening. A carrier disc 11 is mounted on the distribution wheel 8 coaxially with the carrier disc 4 and supports disintegrating wheels 13 mounted by means of support rings 12, each wheel 13 being disposed between two adjacent wheels 6 of the first rotor.

In addition, the disintegrator also comprises a pipe 14 for charging a material 15 to be disintegrated and a pipe 16 for discharging the comminuted material.

Each disintegrating wheel 6 and 13 (FIGS. 1 and 2) comprises a cylindrical shell 17 having openings 18, and a milling body 19 is provided behind each opening on one side thereof. To prevent the material 15 being treated from getting into spaces between the cylindrical shells 17 and carrier discs 4 and 11, each wheel 6 and 13 is provided with a pair of guard members 20 and 21 mounted in mutually perpendicular planes. The guard member 20 comprises a ring and is secured to the periphery of the cylindrical shell 17 on the inner side thereof to extend around the group of the milling bodies 19 provided on this shell 17. The other guard member 21 comprises a cylindrical ring secured to the inner surface of the carrier disc 4 or 11, respectively, opposite to the guard member 20. The outside diameter of the guard member 21 is substantially equal to the inside diameter of the cylindrical shell 17 and the height thereof is substantially equal to the amount of space between the end face of the cylindrical shell 17 and the carrier disc 4 or 11, respectively.

Figure 2:
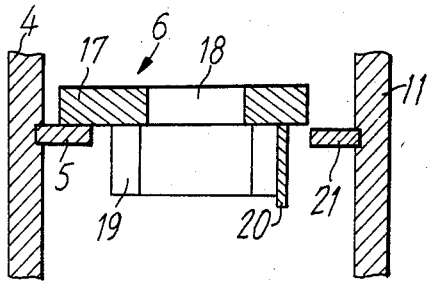
FIG. 2 shows relative position of rotor elements according to the invention.
Figure 3:
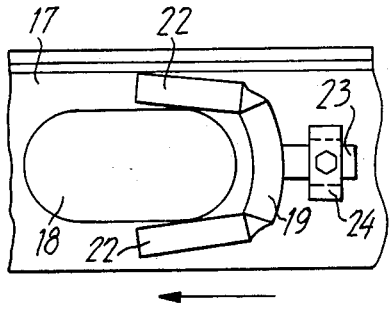
FIG. 3 shows position of milling bodies on a disintegrating wheel relative to a guard member and opening of a shell according to the invention.

Each milling body 19 (FIG. 3) comprises a circularly bent plate having its concave side, which is the active side, facing toward the opening 18 of the cylindrical shell 17 and opposite to the direction of rotation of the respective carrier disc 4 or 11 (FIG. 2).

The milling body 19 (FIG. 3) may be made in the form of a detachable member for a rapid replacement after wear. For that purpose, flat sides 22 and a mounting shank 23 are secured to the working side thereof. These elements are secured to the shell 17, e.g. by means of mounting arms 24.

During operation of the disintegrator, the material 15 being disintegrated (FIG. 1) is admitted through the pipe 14 to the milling chamber 1. Air flow is admitted together with the material. The flow of the material 15 gets to the disintegrating wheels 6 and 13. The material 15 collides with the milling bodies 19 on each wheel 6 or 13. The guard members 20 and 21 prevent a spurious air flow and flow of material 15 from moving laterally over the edge of the shell 17 into the space between the disintegrating wheels 6 or 13 and carrier discs 4 or 11, respectively. The suppression of the spurious flow of air and material 15 is effected by the provision of the guard members 20 and 21 and a narrow space between the shell 17 and the cylindrical ring of the guard member 21. A layer of the material 15 being disintegrated is formed on the inner side of the shell 17 to protect the ring of the guard member 21 from wear.

The comminuted material is discharged from the disintegrator through the pipe 16.

If large-size foreign bodies get into the rotors by accident, two adjacent disintegrating wheels 6 and 13 will be jammed and stripped away because they are weakly secured to the support rings 5 and 12. The disintegrating wheels 6 and 13 are secured to the support rings 5 and 12, e.g. by welding in such a manner as to ensure normal operation of the disintegrator, the connection being broken-down when the load under emergency conditions becomes more than ten times greater than that during normal operation. Thereby the possibility of damage to the drive and carrier discs 4 and 11 is eliminated.

The disintegrator according to the invention makes it possible to improve efficiency of comminution of the material 15 by increasing the number of collisions of particles of the material 15 with the disintegrating wheels 6 and 13 and by lowering spurious flow of air and material 15 so as to prolong service life of the carrier discs 4 and 11. Under emergency conditions, the invention eliminates damage to the drive and to the carrier discs 4 and 11.

INDUSTRIAL APPLICATION

The invention may be used in the manufacture of building materials and in the chemical processing industry.

We claim:

1. A disintegrator comprising:

pipes for charging a material to be disintegrated and for discharging resulting comminuted material, a milling chamber, two rotors mounted on drive shafts in said milling chamber for rotation opposite relative to each other, a first rotor comprising a first carrier disc mounted on one drive shaft and first disintegrating wheels mounted concentrically thereon, and a second rotor comprising a transfer disc mounted on the other drive shaft in parallel with the carrier disc of the first rotor, a distribution wheel provided on the periphery of the transfer disc, a second carrier disc secured to the distribution disc coaxially with the first carrier disc of the first rotor, and second disintegrating wheels mounted concentrically on the carrier disc, at least one second disintegrating wheel being disposed between two adjacent first disintegrating wheels mounted on the first carrier disc of the first rotor, all of said disintegrating wheels comprising a cylindrical shell having openings and a milling body provided behind each opening on one side thereof, said milling body comprising a circularly bent plate having a concave side facing toward the respective opening and opposite to the direction of rotation of the respective carrier disc, CHARACTERIZED in that each of the first and second disintegrating wheels mounted on the carrier discs of the first and second rotors is provided with a pair of guard members installed in two mutually perpendicular planes for preventing the material being disintegrated from getting into spaces between the carrier discs and disintegrating wheels, one guard member comprising a ring mounted on the periphery of each cylindrical shell on the inner side thereof and substantially perpendicular thereto to extend around the group of the milling bodies provided on this cylindrical shell, the other guard member comprising a cylindrical ring secured to the inner surface of the respective carrier disc and substantially perpendicular to the respective carrier disc and the one guard member, the outside diameter of the other guard member secured to the carrier disc being substantially equal to the inside diameter of the respective cylindrical shell so as to be slightly offset in the radial direction from the respective cylindrical shell, and the height thereof being substantially equal to the amount of space between the respective carrier disc and the end face of the cylindrical shell so as to extend from the respective carrier disc to a point immediately adjacent the end face of the cylindrical shell, wherein a narrow slit is provided between the other guard member and the cylindrical shell.

* * * * *